US008939877B2

(12) United States Patent
Waldrop et al.

(10) Patent No.: US 8,939,877 B2
(45) Date of Patent: Jan. 27, 2015

(54) METHOD AND APPARATUS FOR FORMING FAN-FOLDED WEB OF LABELS WITH IMPROVED REGISTRATION

(75) Inventors: Neil C. Waldrop, Greer, SC (US); Jeffrey S. Morris, Hillsboro, OH (US)

(73) Assignee: Century Printing & Packaging, Inc., Greer, SC (US)

( * ) Notice: Subject to any disclaimer, the term of this patent is extended or adjusted under 35 U.S.C. 154(b) by 578 days.

(21) Appl. No.: 13/352,491

(22) Filed: Jan. 18, 2012

(65) Prior Publication Data

US 2013/0184138 A1 Jul. 18, 2013

(51) Int. Cl.
*B31F 1/08* (2006.01)
*B31F 1/10* (2006.01)

(52) U.S. Cl.
USPC ..... 493/413; 493/424; 493/430

(58) Field of Classification Search
CPC ..... B65H 45/00; B65H 45/12; B65H 45/16; B65H 45/20; B65H 45/30
USPC ..... 53/413, 424, 430
See application file for complete search history.

(56) References Cited

U.S. PATENT DOCUMENTS 3,684,275 A * 8/1972 Schweitzer et al. ..... 493/10
4,765,604 A * 8/1988 Trogan ..... 270/39.09
5,000,725 A * 3/1991 Bauknecht ..... 493/11
5,065,992 A * 11/1991 Crowley ..... 270/39.05
5,076,555 A * 12/1991 Bunch, Jr. ..... 270/39.05
5,348,277 A * 9/1994 Crowley ..... 270/39.05
6,067,775 A * 5/2000 O'Connor ..... 53/429
6,290,635 B1 * 9/2001 Demmel et al. ..... 493/399
6,669,617 B1 * 12/2003 Sumida et al. ..... 493/359
7,762,939 B2 7/2010 George
7,985,170 B2 * 7/2011 George ..... 493/375
8,166,857 B2 * 5/2012 Powell et al. ..... 83/30
8,226,535 B2 * 7/2012 George ..... 493/442
2008/0200324 A1 * 8/2008 Morelli et al. ..... 493/430
2009/0239728 A1 * 9/2009 Bartesaghi ..... 493/430

* cited by examiner

*Primary Examiner* — Gloria R Weeks

(74) *Attorney, Agent, or Firm* — John B. Hardaway, III; Nexsen Pruet, LLC

(57) ABSTRACT

An off line apparatus for converting a rolled web into a fan-fold web and method of fan folding a web is described. The apparatus has a creasing station capable of receiving the web at a feed rate. The creasing station has a first die roller, wherein the first die roller comprises a first blade and a first cushion, and a second die roller. A coupling mechanism synchronizes rotation of the rollers such that the first blade engages the second cushion and the second blade engages the first cushion during one each rotation. A reader determines the location of a gap between the labels. A controller receives the location of the gap from said reader and communication with a drive mechanism to adjust the rotation rate such that the first blade and the second cushion engage.

18 Claims, 3 Drawing Sheets

METHOD AND APPARATUS FOR FORMING FAN-FOLDED WEB OF LABELS WITH IMPROVED REGISTRATION

BACKGROUND

The present invention is related to an improved method for forming a fan-folded web of labels, particularly pressure sensitive labels, with improved registration of the fold relative to the position of the labels. More particularly, the present invention is related to an improved method of forming a fan-folded web of labels wherein the formation of fan-fold creases can be correctly registered even with perturbations in the motion of the web.

There has been a long standing need for the formation of fan-folded arrangements of webs containing labels. Typically, the webs are formed with labels adhered thereto in a repeating pattern typically with a fixed frequency. The web is then passed through a creasing station wherein creases are formed in the web, between labels, and the web is folded in alternating fashion at the creases. Typically, perforations have assisted in forming a fold. Previously webs have been creased or perforated in line transversely across the web on alternating sides to form folds at the creases or perforations in alternating directions thereby allowing the fan-fold labels to be stored and boxed for transport and subsequent use. Such a web 10 is illustrated in FIG. 1 with labels 12 and folds 14 being placed in bin 16.

To ensure the creases, and therefore folds, are correctly registered between labels the mechanism for transporting the web through the crease station has been mechanically coupled with die rolls thereby insuring that any fluctuation in speed of the web, the length of the labels or the web tension will be in concert with the rotation of the die rolls. An exemplary teaching of such a machine is described in U.S. Pat. No. 7,762,939.

While the in-line machines currently available in the art have enjoyed much success in commerce they still have certain deficiencies in flexibility which have become accepted.

In spite of the relative success of web creasing machines for formation of fan-fold webs the art still has a strong desire for an improved design which will advance the art of fan-folding webs of material, particularly, webs comprising labels such as self-adhesive or pressure-adhesive labels.

SUMMARY

It is an object of the invention to provide an improved method for forming a fan-folded web.

It is another object of the invention to provide a creasing station which creases a web on alternating faces at a fixed separation with minimal error due to variations in web speed or web conditions or label conditions.

A particular feature of the invention is the ability to decouple the rate of creasing from the web movement thereby allowing for alteration of the position of the crease in the event of a perturbation in the web or web feed.

These and other embodiments, as will be realized, are provided in an apparatus for converting a rolled web into a fan-fold web. The apparatus has a creasing station capable of receiving the web at a feed rate. The web comprises labels thereon. The creasing station has a first die roller, wherein the first die roller comprises a first blade and a first cushion, and a second die roller, wherein said second die roller comprises a second blade and a second cushion. A coupling mechanism synchronizes rotation of the first die roller and the second die roller such that the first blade engages the second cushion and the second blade engages the first cushion during one each rotation. A reader is provided which is capable of determining the location of a gap between the labels. A controller is provided which is capable of receiving the location of the gap from said reader and communication with a drive mechanism to adjust the rotation rate of said first die roller, independent of the feed rate, such that the first blade and the second cushion engage at the gap thereby forming a crease at the gap.

Yet another embodiment is provided in a method for converting a rolled web into a fan-folded web. The method includes:

providing a roll of web wherein the web comprises labels thereon with gaps between the labels;

passing the roll through a creasing station at a feed rate wherein the creasing station comprises:

a first die roller wherein the first die roller comprises a first blade and a first cushion;

a second die roller wherein the second die roller comprises a second blade and a second cushion;

a coupling mechanism synchronizing rotation of the first die roller and the second die roller such that the first blade engages the second cushion and the second blade engages the first cushion during one rotation;

a reader capable of determining a location of a first gap;

a controller capable of receiving the location of the first gap from the reader; and a drive mechanism in communication with the controller wherein a rotation rate of the first die roller is adjusted independent of the feed rate such that the first blade and the second cushion engage at the first gap thereby forming a first crease at the first gap;

rotating the first die roller and the second die roller until the second blade and the first cushion engage at a second gap of the gaps thereby forming a second crease at the second gap wherein the second crease is on an opposite side of the web from the first crease; and folding the web at the first crease and the second crease thereby forming the fan-folded web.

DETAILED DESCRIPTION

In accordance with this invention, it has been found that fan-folded webs can be creased off line but that many problems must be addressed. If the web slips, stretches or otherwise loses registration with the die rolls there is a high likelihood that some labels will be damaged. Furthermore, if the size, spacing or periodicity of the labels changes even slightly the registration between the die rolls and web transport must be altered such as by changing gear ratios or the like. Any inaccuracy in the periodicity of the creases with respect to the periodicity of the labels will eventually lead to a misregistration of the creases.

The present invention is related to an improved off line creasing station for the formation of a fan-folded web and an improved method of forming a fan-folded web which overcomes the problems discussed above. More specifically, the present invention is related to a crease station wherein the rate of rotation of the die rolls is driven independently from the rate of web movement using optical characterization of label placement on the web for controlling the die roll rotation rate.

The invention will be described with reference to the figures which form an integral, non-limiting component of the disclosure. Throughout the specification similar elements will be numbered accordingly.

Figure 1:
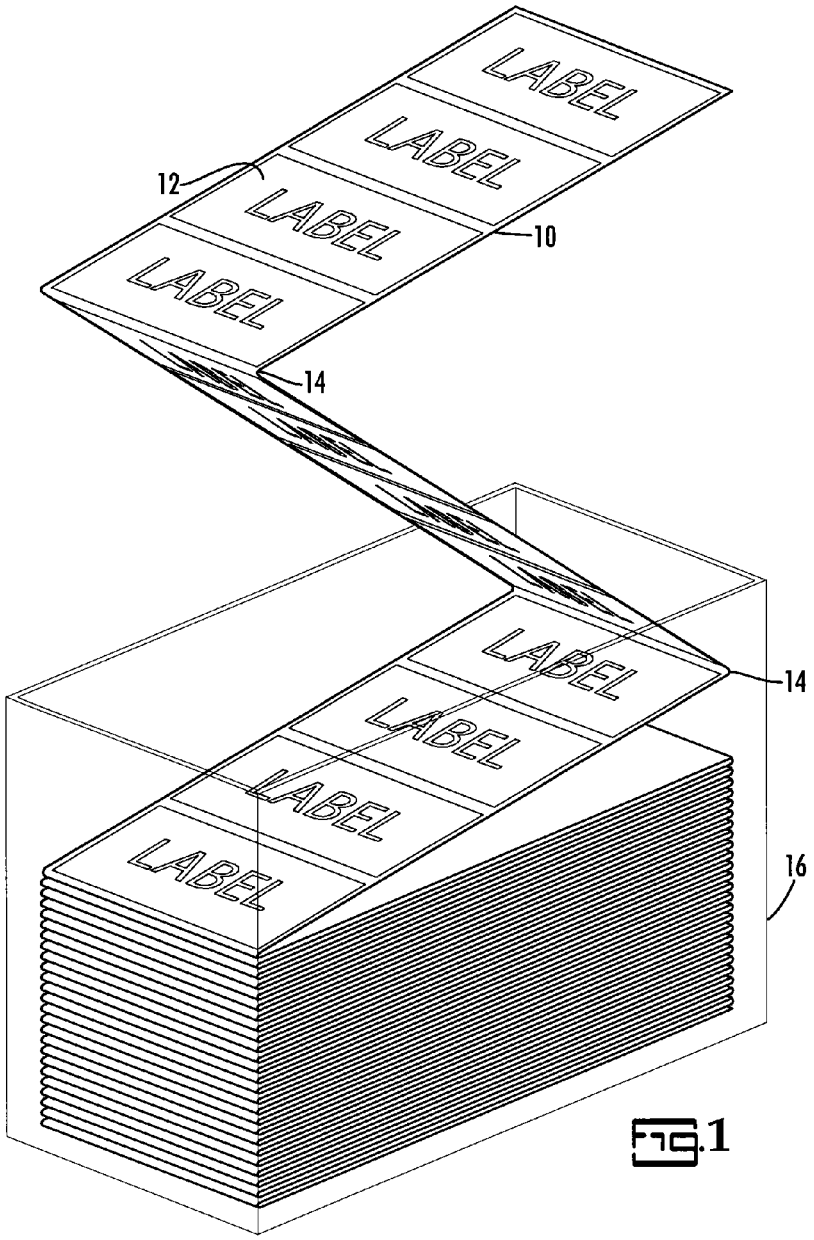
FIG. 1 is a perspective schematic view of a fan-folded web with labels thereon.
Figure 2:
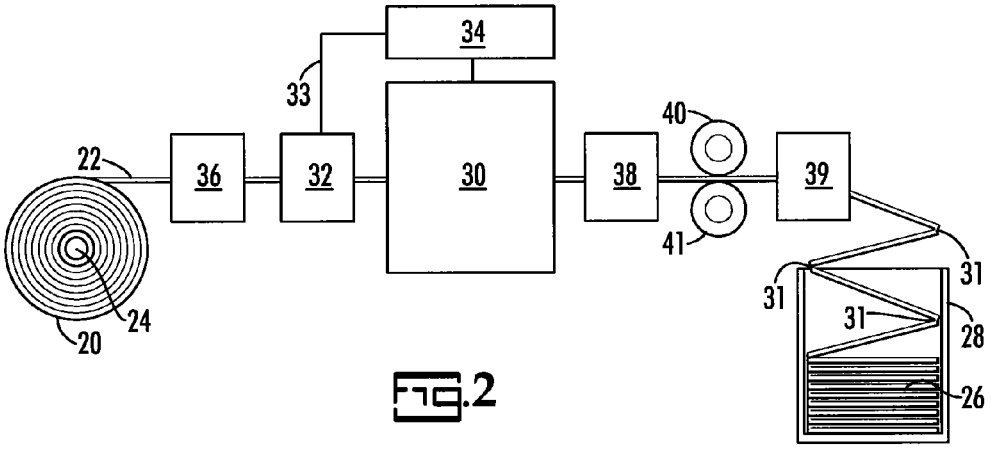
FIG. 2 is a schematic side view of an embodiment of the invention.

A schematic view of an embodiment of the invention is illustrated in FIG. 2. In FIG. 2, a roll, 20, of web, 22, on a mandrel, 24, is converted to a fan-fold stack, 26, of web in a bin, 28. A crease station, 30, which will be described more fully below, creases the web between labels and on alternate sides. The folds, 31, occur at the creases. An optical reader, 32, determines the location of gaps between labels and relays the spacing to a controller, 34, through a communication link, 33, which may be electrical, optical or wireless communication. The controller regulates the rotation rate of roller dies within the crease station thereby insuring that the crease is between labels and appropriately spaced. A splicer, 36, allows sequential rolls to be joined thereby forming a near-continuous operation. The splicer may also allow sections of a roll to be removed and either end thereof rejoined to remove areas with defective labels, defective web or both. An optional, but preferred, finishing station, 38, may provide an inspection function to insure defective sections do not reach the bin. The finishing station may have a splicer in some instances thereby allowing removal of defects. Nip rollers, 40 and 41, draw the web through the various stations with tension provided by resistance, preferably, at the mandrel, 24. A folder, 39, persuades the web to fold at the crease. The folder may be mechanical, such as brushes or rollers, or may persuade the web to fold by air pressure or the like. Various rollers, guides, compression wheels and the like would be incorporated throughout as would be well known to one of ordinary skill in the art and further elaboration of the details associated with web control are not repeated herein.

Figure 3:
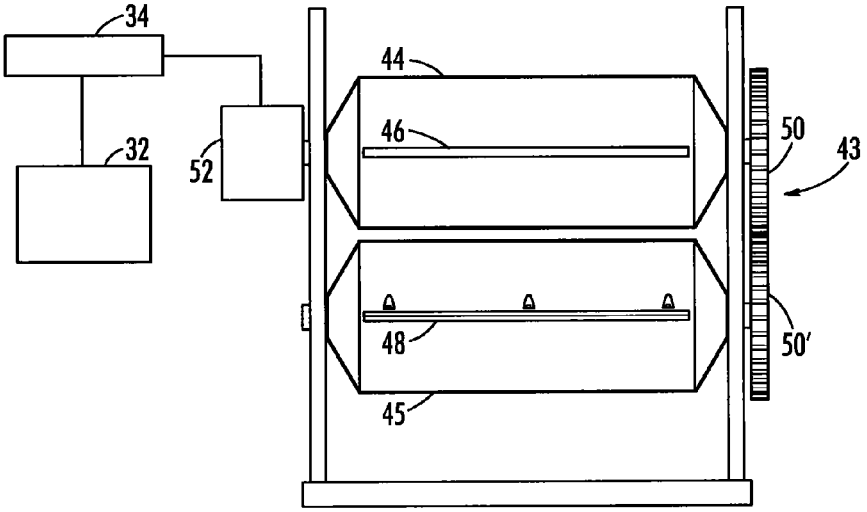
FIG. 3 is a schematic partial view of an embodiment of the invention.

A partial view of an embodiment of the invention is illustrated in FIG. 3 wherein illustrated schematically is a complementary pair of die rollers, 44 and 45, which turn in opposite directions in concert. Each die roller has a cushion, 46, and a blade, 48, wherein a blade from one die roller engages a cushion of the other die roller to form a crease in the web passing there between. In FIG. 3 the cushion, 46, of the top die roller, 44, is visible and the blade, 48, of the bottom roller, 45, is visible with the complementary component of each die roller being obscured from view. A coupling mechanism, 43, synchronizes the die rollers in counter rotating relationship wherein the rotation is properly timed such that the blade of one die roller and cushion of the other die roller arrive at the web in mating relationship. A preferred coupling mechanism comprising mating meshed gears, 50, with a common diameter insures the die rollers remain in counter-rotating synchronization. It is preferable that the die rollers rotate such that the face of the roller is moving in the same direction as the web.

A die roller drive, 52, which is preferably a servo motor, drives one die roller with the other rotating in synchronized fashion as described above. For the purposes of illustration the upper die roller, 44, is a master roller which is coupled to the die roller drive and the lower die roller, 45, is a slave roller which follows the master roller through the coupling mechanism. The rate of rotation of the die rollers is controlled by the controller, 34, based on a signal from the optical reader, 32. A particular feature of the present invention is that the rotation rate of the die rollers is independent of the feed rate of the web. The optical reader determines the exact location of spacing between the labels and, based on the determined location, the controller manipulates the rotation rate of the die rollers, through the die roller drive, to insure that the blade and cushion arrive at the proper location on the web to insure a crease is properly located between labels. In the event of a perturbation in the web transport, such as a slippage in the web relative to the web drive mechanism, the rotational rate of the die rollers can be adjusted by the controller based on a change in the determined position of the gap between labels as recognized by the optical sensor. Therefore, the crease can be correctly placed without regard for perturbations in the movement of the web. The ability to compensate for web movement perturbations provides a significant advantage over the prior art since a perturbation in a mechanically coupled creaser would necessarily cause a misregistration of the crease thereby ultimately leading to a defective fan-folded web. Various bearings, fittings, couplings and the like are not illustrated since these are not particularly limiting and many variations and arrangements could be easily arrived at based on standard engineering practice.

The optical sensor is not limiting with the proviso that the optical sensor is capable of distinguishing the gap on the web between labels without regard for design or color.

Figure 4:
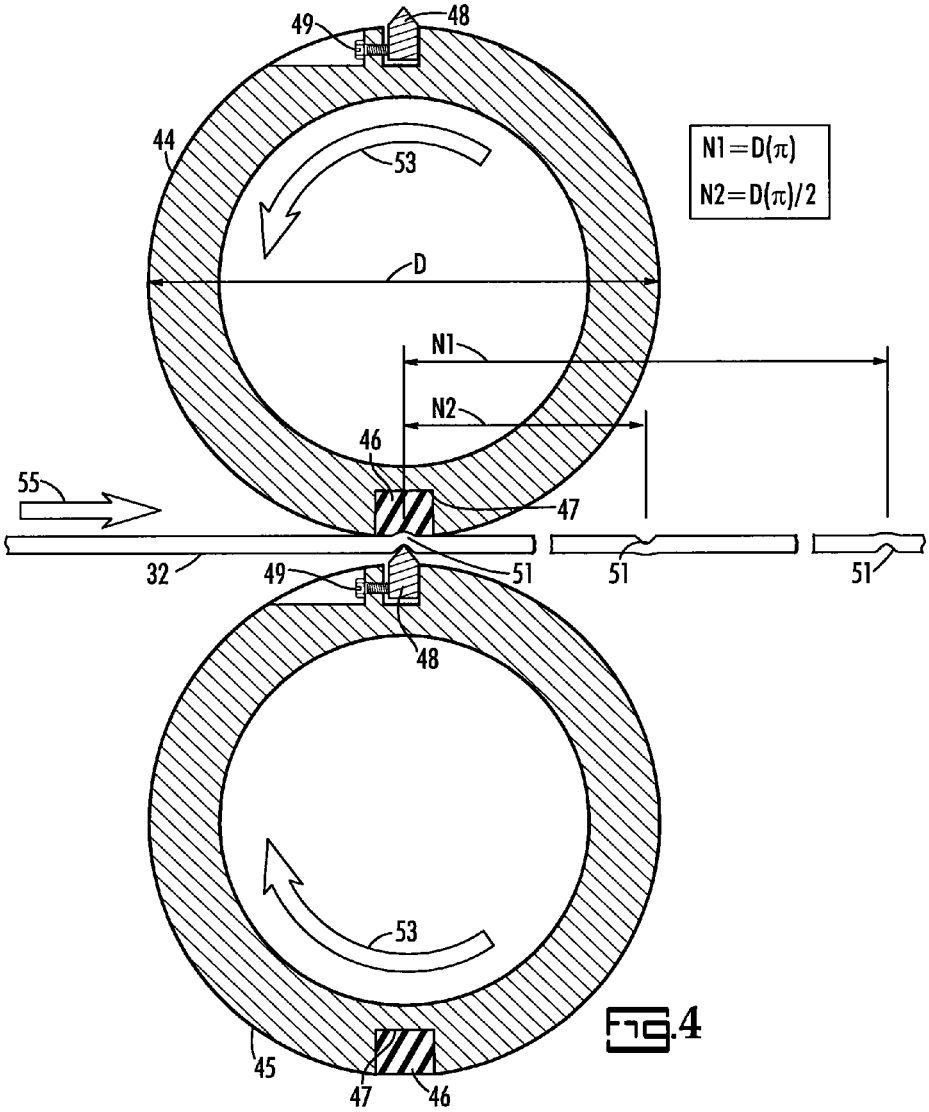
FIG. 4 is a schematic cross-sectional view of an embodiment of the invention.

An embodiment of the invention will be described with reference to FIG. 4 wherein illustrated is a pair of complementary die rollers, in creasing orientation, taken in cross-section. In FIG. 4, an upper die roller, 44, and a lower die roller, 45, are rotationally coupled to have the same rotational rate in opposing direction as realized from previous discussion. Each die roller has a blade, 48, which is secured to the die roller such as by threaded members, 49. On the opposite side of the die roller a cushion, 46, is provided in a channel, 47, of the die roller. The die rollers preferably rotate in the direction of arrows, 53, and the web moves in the direction of arrow, 55. Twice during each full rotation of the die rollers a blade of one die roller and a cushion of the other die roller meet with the web there between wherein the blade presses the web against the cushion thereby forming a crease, 51. The rollers are separated by a distance sufficient for the web to pass between the rollers, between creases, without contacting either roller.

Discounting adjustments due to perturbations, the separation of creases is defined relative to the diameter, D, of the die rollers. Creases on a common face are separated by N1 which is the circumference of the die roller, or $D\pi$. Adjacent creases on opposing faces are separated by N2 which is half of the circumference or $D\pi/2$. While demonstrated as a cylindrical die roller the die rollers could be other shapes as long as the blade and cushion track a circular path with the desired diameter.

The fan-folded webs are typically used in newspaper labeling operations at very high speeds. It is not uncommon for over 1000 labels to be applied per minute. This high rate of speed requires a web with a sufficient structural strength to avoid tears. It is therefore preferable to avoid perforations when forming the creases.

A particular advantage of the instant invention is the elimination of the necessity for a high level of web tension. With prior art, mechanically coupled, creasers the web must be maintained in relatively high tension to insure that the movement through various rollers and drives is consistent with minimal slippage. With the present invention the determination of the gap between labels is accomplished just prior to the creaser thereby eliminating the need for a high degree of web tension. There must be sufficient tension to avoid buckling between the optical sensor and creasing but this is easily accomplished with relatively low web tension.

While not limited thereto, the primary commercial application of the creaser is for forming fan fold webs which are narrow, such as about 5.08 to about 10.16 cm (about 2 to about 4 inches), with labels that are approximately 7.62 cm (3 inches) in length. The gap between labels is intentionally kept to a minimum to minimize the total length of the web with a gap of about 3.175 mm (0.125 inches) being most common. The length of each ply of fan-folded web is not particularly limited by the invention but a length of about 31.75 cm (12.5 inches) is most preferred since this is a standard size employed by most modern label application machines. The width of the web, the size of the labels, the gap between labels, etc. can be easily adjusted and the creaser of the present invention can be easily adjusted to accommodate from very small to very large samples.

Throughout the specification positional terms such as upper and lower are for convenience of discussion and may have no basis or relevance in actual practice.

The web is not particularly limited herein. In practice, a laminated web with a release layer is most commonly employed. The label typically has a pressure-sensitive adhesive coating thereon. In use the labels are removed from the web and applied to a surface, such as a newspaper, and the web is discarded. The manner in which the web is formed, the manner in which the labels are applied to the web and the manner in which the labels are removed from the web for application is not particularly limited herein and the inventive creaser, and method of creasing, is intended to coordinate with existing and future equipment before and after the creasing operation.

The invention has been described with reference to the preferred embodiments without limit thereto. One of skill in the art would realize additional embodiments and improvements which are not specifically set forth herein but which are within the metes and bounds of the claims appended hereto.

The invention claimed is:

1. An apparatus for converting a rolled web into a fan-fold web comprising:

a creasing station capable of receiving said web at a feed rate wherein said web comprises labels thereon and wherein said creasing station comprises:

a first die roller wherein said first die roller comprises a first blade and a first cushion;

a second die roller wherein said second die roller comprises a second blade and a second cushion;

a coupling mechanism synchronizing rotation of said first die roller and said second die roller such that said first blade engages said second cushion and said second blade engages first cushion during one said rotation;

a reader capable of determining a location of a gap between said labels;

a controller capable of receiving said location of said gap from said reader; and a drive mechanism in communication with said controller wherein a rotation rate of said first die roller is adjusted independent of said feed rate such that said first blade and said second cushion engage at said gap thereby forming a crease at said gap.

2. The apparatus for converting a rolled web into a fan-fold web of claim 1 wherein said drive mechanism is a servo motor.

3. The apparatus for converting a rolled web into a fan-fold web of claim 1 wherein said reader is an optical reader.

4. The apparatus for converting a rolled web into a fan-fold web of claim 1 further comprising a splicer.

5. The apparatus for converting a rolled web into a fan-fold web of claim 1 further comprising a bin for collecting said fan-fold web.

6. The apparatus for converting a rolled web into a fan-fold web of claim 1 wherein said first die roller and said second die roller are separated by a distance.

7. The apparatus for converting a rolled web into a fan-fold web of claim 1 wherein said coupling mechanism comprises gears.

8. The apparatus for converting a rolled web into a fan-fold web of claim 1 further comprising a finishing station.

9. The apparatus for converting a rolled web into a fan-fold web of claim 1 wherein at least one of said first die roller and said second die roller is cylindrical.

10. A method for converting a rolled web into a fan-folded web comprising:

providing a roll of said web wherein said web comprises labels thereon with gaps between said labels;

passing said roll through a creasing station at a feed rate wherein said creasing station comprises:

a first die roller wherein said first die roller comprises a first blade and a first cushion;

a second die roller wherein said second die roller comprises a second blade and a second cushion;

a coupling mechanism synchronizing rotation of said first die roller and said second die roller such that said first blade engages said second cushion and said second blade engages first cushion during one said rotation;

a reader capable of determining a location of a first gap of said gaps;

a controller capable of receiving said location of said first gap from said reader; and a drive mechanism in communication with said controller wherein a rotation rate of said first die roller is adjusted independent of said feed rate such that said first blade and said second cushion engage at said first gap thereby forming a first crease at said first gap;

rotating said first die roller and said second die roller until said second blade and said first cushion engage at a second gap of said gaps thereby forming a second crease at said second gap wherein said second crease is on an opposite side of said web from said first crease; and folding said web at said first crease and said second crease thereby forming said fan-folded web.

11. The method for converting a rolled web into a fan-folded web of claim 10 wherein said drive mechanism is a servo motor.

12. The method for converting a rolled web into a fan-folded web of claim 10 wherein said reader is an optical reader.

13. The method for converting a rolled web into a fan-folded web of claim 10 further comprising splicing a second web to said web.

14. The method for converting a rolled web into a fan-folded web of claim 10 further comprising collecting said fan-fold web in a bin.

15. The method for converting a rolled web into a fan-folded web of claim 10 wherein said first die roller and said second die roller are separated by a distance.

16. The method for converting a rolled web into a fan-folded web of claim 10 wherein said coupling mechanism comprises gears.

17. The method for converting a rolled web into a fan-folded web of claim 10 further comprising passing said web through a finishing station.

18. The method for converting a rolled web into a fan-folded web of claim 10 wherein at least one of said first die roller and said second die roller is cylindrical.

* * * * *